US009433053B2

(12) United States Patent
Neudorf

(10) Patent No.: US 9,433,053 B2
(45) Date of Patent: Aug. 30, 2016

(54) METHOD AND SYSTEM FOR CONTROLLING SOLID STATE LIGHTING VIA DITHERING

(75) Inventor: Jason Neudorf, Kitchener (CA)

(73) Assignee: LUMASTREAM CANADA ULC, Calgary (CA)

( * ) Notice: Subject to any disclaimer, the term of this patent is extended or adjusted under 35 U.S.C. 154(b) by 0 days.

(21) Appl. No.: 13/640,440

(22) PCT Filed: May 13, 2011

(86) PCT No.: PCT/CA2011/050298

§ 371 (c)(1),
(2), (4) Date: Oct. 10, 2012

(87) PCT Pub. No.: WO2011/140660

PCT Pub. Date: Nov. 17, 2011

(65) Prior Publication Data

US 2013/0049634 A1 Feb. 28, 2013

Related U.S. Application Data

(60) Provisional application No. 61/334,736, filed on May 14, 2010.

(51) Int. Cl.
*H05B 37/02* (2006.01)
*H05B 33/08* (2006.01)

(52) U.S. Cl.
CPC ..... *H05B 33/086* (2013.01); *H05B 33/0866* (2013.01)

(58) Field of Classification Search
None
See application file for complete search history.

(56) References Cited

U.S. PATENT DOCUMENTS 5,184,114 A * 2/1993 Brown ..... G09F 9/33 345/600
7,038,399 B2 * 5/2006 Lys et al. ..... 315/291
7,088,059 B2 * 8/2006 McKinney ..... H05B 33/086 315/291

(Continued)

FOREIGN PATENT DOCUMENTS

EP 2071683 6/2009
WO 03096761 11/2003

OTHER PUBLICATIONS

Canadian Intellectual Property Office as International Searching Authority, International Search Report and Written Opinion for International patent application No. PCT/CA2011/050298, Sep. 1, 2011.

*Primary Examiner* — Alexander H Taningco
*Assistant Examiner* — Nelson Correa
(74) *Attorney, Agent, or Firm* — Gowling WLG (Canada) LLP; Jeffrey W. Wong

(57) ABSTRACT

There is provided a method of controlling solid state lighting (SSL) devices including receiving dimming information; translating the dimming information into SSL control information, the SSL control information including load/LED control information and dithering information; and transmitting the SSL control information to a current source for controlling the SSL devices for white light illumination. Furthermore, the SSL device may be one of lower power light emitting diodes (LEDs), organic LEDs, and high power LEDs.

11 Claims, 9 Drawing Sheets

(56) References Cited

U.S. PATENT DOCUMENTS

| | | | | |
|---|---|---|---|---|
| 7,177,166 | B1 * | 2/2007 | Kris | H02M 1/44 323/282 |
| 7,286,146 | B2 * | 10/2007 | Goldschmidt | G09G 3/14 345/596 |
| 7,667,408 | B2 * | 2/2010 | Melanson | H05B 33/0809 315/209 R |
| 8,000,359 | B2 * | 8/2011 | Sasaki et al. | 372/32 |
| 8,278,840 | B2 * | 10/2012 | Logiudice et al. | 315/294 |
| 8,299,987 | B2 * | 10/2012 | Neudorf et al. | 345/82 |
| 8,339,062 | B2 * | 12/2012 | Cencur | 315/291 |
| 8,362,706 | B1 * | 1/2013 | Godbole | H05B 33/0818 315/291 |
| 8,441,202 | B2 * | 5/2013 | Wilson | H05B 33/0863 315/291 |
| 8,525,446 | B2 * | 9/2013 | Tikkanen et al. | 315/312 |
| 8,957,601 | B2 * | 2/2015 | Tikkanen et al. | 315/294 |
| 9,066,381 | B2 * | 6/2015 | Valois | H05B 37/0227 |
| 2011/0169426 | A1 * | 7/2011 | Sadwick | H05B 41/2824 315/307 |
| 2013/0229215 | A1 * | 9/2013 | Sadwick | H03K 3/84 327/164 |

* cited by examiner

| Dim Command Level | Desired Light Intensity (%) | Attenuation Number | Frequency Band #1 | | Calculated Light Intensity Band #1 (%) | Frequency Band #2 | | Calculated Light Intensity Band#2 (%) | Dithered Weighting Band#1 | Dithered Weighting Band#2 |
|---|---|---|---|---|---|---|---|---|---|---|
| | | | OT1 (us) | P1 (us) | | OT2 (us) | P2 (us) | | | |
| 241 | 71.09 | 3584 | 346 | 486 | 71.19 | 234 | 328 | 71.13 | 1 | 15 |
| | 70.66 | 3648 | 346 | 488 | 70.90 | 234 | 330 | 70.91 | 1 | 15 |
| | 70.23 | 3712 | 346 | 492 | 70.32 | 234 | 332 | 70.48 | 1 | 15 |
| | 69.80 | 3776 | 346 | 494 | 70.04 | 234 | 334 | 70.06 | 1 | 15 |
| 240 | 69.38 | 3840 | 346 | 498 | 69.48 | 234 | 336 | 69.64 | 0 | 16 |
| | 68.96 | 3904 | 346 | 500 | 69.20 | 234 | 338 | 69.23 | 0 | 16 |
| | 68.54 | 3968 | 346 | 504 | 68.61 | 234 | 340 | 68.82 | 0 | 16 |
| | 68.12 | 4032 | 346 | 506 | 68.38 | 234 | 342 | 68.42 | 0 | 16 |
| 239 | 67.71 | 4096 | 234 | 344 | 68.02 | 160 | 236 | 67.79 | 15 | 1 |
| | 67.30 | 4160 | 234 | 346 | 67.63 | 160 | 236 | 67.79 | 15 | 1 |
| | 66.89 | 4224 | 234 | 350 | 66.86 | 160 | 238 | 67.22 | 15 | 1 |
| | 66.48 | 4288 | 234 | 352 | 66.48 | 160 | 240 | 66.66 | 15 | 1 |
| 238 | 66.08 | 4352 | 234 | 354 | 66.10 | 160 | 242 | 66.11 | 14 | 2 |
| | 65.68 | 4416 | 234 | 356 | 65.73 | 160 | 242 | 66.11 | 14 | 2 |
| | 65.28 | 4480 | 234 | 358 | 65.36 | 160 | 244 | 65.57 | 14 | 2 |
| | 64.88 | 4544 | 234 | 360 | 65.00 | 160 | 246 | 65.04 | 14 | 2 |

FIGURE 6

METHOD AND SYSTEM FOR CONTROLLING SOLID STATE LIGHTING VIA DITHERING

CROSS REFERENCE TO RELATED APPLICATIONS

This application claims the benefit of U.S. Provisional Patent Application No. 61/334,736, filed May 14, 2010, which is incorporated herein by reference in its entirety.

BACKGROUND OF THE DISCLOSURE

A solid state lighting device (SSL) is a semiconductor light source and is typically used in a variety of lighting applications such as indicator lamps, accent lighting, general illumination, and color changing in the entertainment industry. Examples of SSL devices include low power light emitting diodes (LEDs), Organic LEDs (OLEDs), and high power LEDs (PLEDs). The application of such devices often requires dimming or control in such a manner to mitigate flicker effects and provide a visually appealing change in light intensity or smooth dimming performance. However, the human eye can perceive abrupt changes in intensity levels for changes as small as 1% and particularly at low intensity levels. This phenomenon is known as flicker.

Therefore, it is provided a method and system for controlling SSL devices using dithering.

BRIEF DESCRIPTION OF THE DRAWINGS

Embodiments of the present disclosure will now be described, by way of example only, with reference to the attached Figures, wherein:

FIG. 6 is a table illustrating dithered variable frequency values for a range of dimming command levels;

DETAILED DESCRIPTION OF THE DISCLOSURE

The present disclosure is directed at a system and method of controlling solid state lighting devices (SSLs) such as light emitting diodes (LEDs), preferably smooth dimming or color changing LEDs. In one embodiment, the system and method control the LEDs over a wide dynamic light intensity range or contrast ratio. While much of this disclosure refers to LEDs, other SSL devices may also be used without loss of generality.

A digital filter is implemented to produce a high-resolution light intensity signal by filtering a lower resolution light intensity signal. There are two distinct stages for dimming or color changing LEDs to achieve a wide dynamic dimming range; for a first range of light intensities, the present disclosure implements a pure variable frequency solution (constant on time with variable period).

For a second range of light intensities, the present disclosure dithers between two or more variable frequency bands. Each variable frequency band has a distinct on time, and variable period and multiple variable frequency bands are utilized to reduce the frequency range of the current pulse provided to the LED load over the dimming range.

Dithering between variable frequency bands while changing light intensity commands mitigates the impact of deviations in average current supplied to a LED load during transitions to different on-times. This reduces the likelihood of a perceptible jump in light intensity.

By dithering between different variable frequency bands, average current to the load is encoded within the five variables of a first on time and off-time pair (on1, off1) and a second on time and off-time pair (on2, off2) as well as a ratio or weighting (n) between the pairs.

In order to minimize flicker when ramping over a wide dynamic range or contrast ratio from less than 1% to a full intensity of 100%, it is preferred that each change in intensity be significantly less than a 1% change from the previous level.

Furthermore, for applications requiring a wide dynamic dimming range of less than 1% to 100% full intensity, a pulse current comprising a very low duty cycle of on time versus period may be required.

In another embodiment, there is provided a system and method for improved dimming performance over a wide dynamic light intensity range.

Figure 1A:
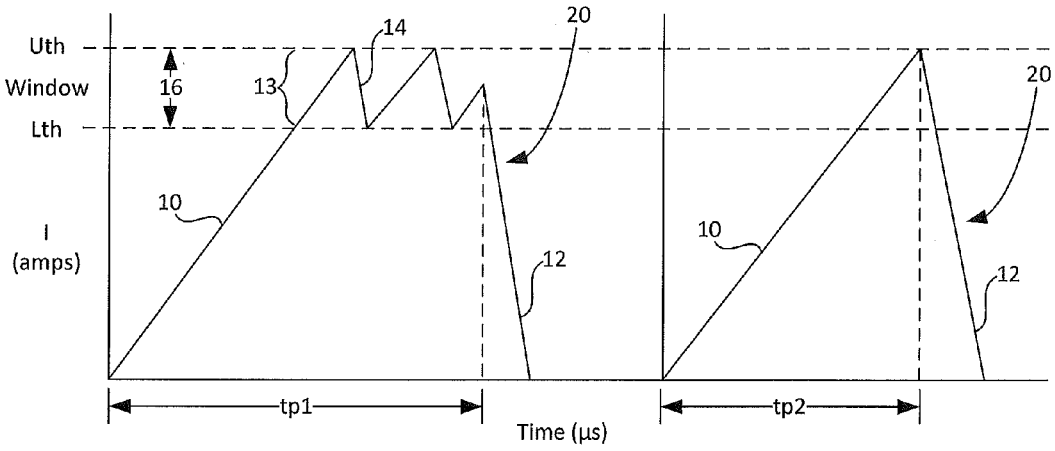
FIGURE 1a (PRIOR ART)
FIG. 1*a* is a graph showing actual current pulse waveforms for a hysteretic controlled current source.
Figure 1B:
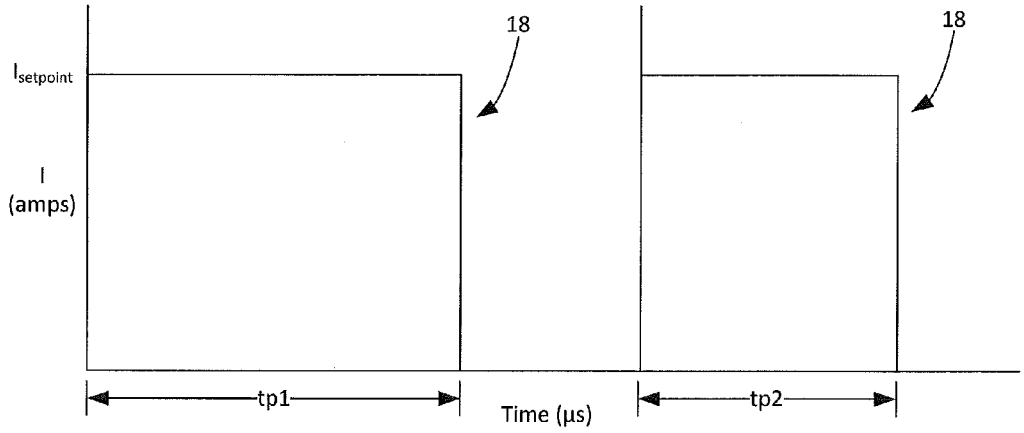
FIGURE 1b (PRIOR ART)
FIG. 1*b* is a graph showing computed current pulse waveforms for a hysteretic controlled current source.

Turning to FIGS. 1*a* and 1*b*, a pair of graphs which relate to an actual current pulse waveform versus a computer generated current pulse waveform for a hysteretic controlled current source are provided. As shown, the y-axis represents current in amps while the x-axis represents time in microseconds (μs). The intensity of a load from a light emitting diode (LED) may be expressed not only in terms of average current but also in terms of total charge transferred by an output current pulse to an LED load.

Figure 2:
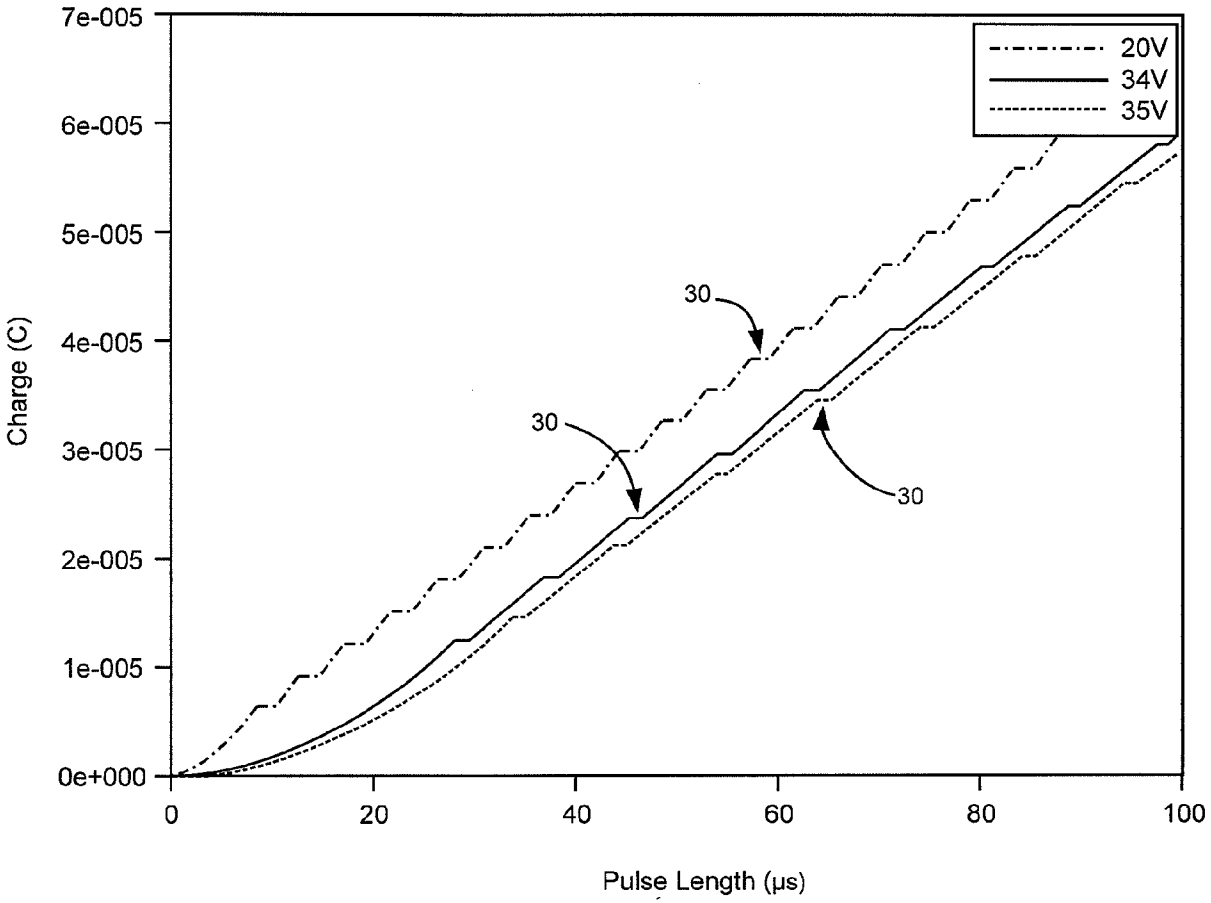
FIGURE 2 (PRIOR ART)
FIG. 2 is a graph showing charge transferred vs pulse duration.

As can be seen in FIG. 2, the integrated area of a pulse (ie, the charge transferred during the pulse) is non-linear with respect to the time of the pulse and only approximates the total charge which might be transferred by an ideal hysteretic controller. As shown in FIG. 1*a*, which is a graph of a sample current pulse waveform, the waveform contains a ramp up 10 and a ramp down 12 transition time as well as a sawtooth component 14 determined by an upper limit (Uth) and a lower limit (Lth) which is established as part of the hysteretic window 16.

FIG. 1*a* also shows actual waveforms generated by a hysteretic control means for an input voltage of Vin=40V, a voltage drop across an LED load of 35V, and an inductor value of 220 uH for a given hysteretic window (Uth and Lth limits) 16 and two representative pulse widths (tp1 and tp2). The greater the voltage drop across the LED load (VLED), the lower the voltage drop across the inductor (VL) and a corresponding slower ramp up transition time (di/dt) 10:

$$di/dt=VL/L$$

where VL=Vin−VLED

For an ideal hysteretic controlled current source (as shown in FIG. 1*b*), the total charge transferred during an output pulse may be calculated as:

$$\text{(Total Charge) } Q=I_{setpoint}\times T_{on}$$

where $I_{setpoint}$ is the average current of the upper (Uth) and lower (Lth) limits during the on time (also referred to as hysteretic current set point) and $T_{on}$ is the on time.

Note the difference in area under the waveform curve between the computed pulse waveforms 18 and the actual pulse waveforms 20 represents the error or difference in charge supplied to the LED load. This is particularly significant for narrow pulse widths and therefore lower light intensities. The error increases in magnitude as the actual charge represented by the area under the curve as shown in FIG. 1*a*, deviates from a predicted charge for narrow pulse widths resulting in a perceptible change in light intensity as the dimming intensity command signal transitions between different intensity levels.

FIG. 2 is a graph showing the amount of charge transferred to an LED load for a plurality of LED voltage drops (20V, 34V, 35V) and various pulse widths. The y-axis of the graph represents charge, in Coulombs, while the x-axis represents pulse length, in microseconds. As shown in the graph, the charge transferred versus pulse duration does not linearly increase as a function of time but moves in "steps" 30 which are the result of the downward slope of the sawtooth waveform 14 generated within the hysteretic window 16 as shown in FIG. 1*a*. The steps are dependent on the output voltage to the LED load and cause an offset in total current supplied.

The downward slope of the sawtooth waveform 14 in FIG. 1*a* (represented by the off time of the hysteretic controller MOSFET switch) results in no increase in charge and therefore no change in light intensity for small increases in pulse duration. If the current pulse is required to change as a result of a revised dimming intensity command request when the hysteretic controller MOSFET switch is turned off, there will be no corresponding change in charge transferred as shown by lines 30. If this error is on the order of 1% or more, the result is a perceivable jump in light intensity as the dimming intensity command signal transitions between intensity levels.

Figure 3:
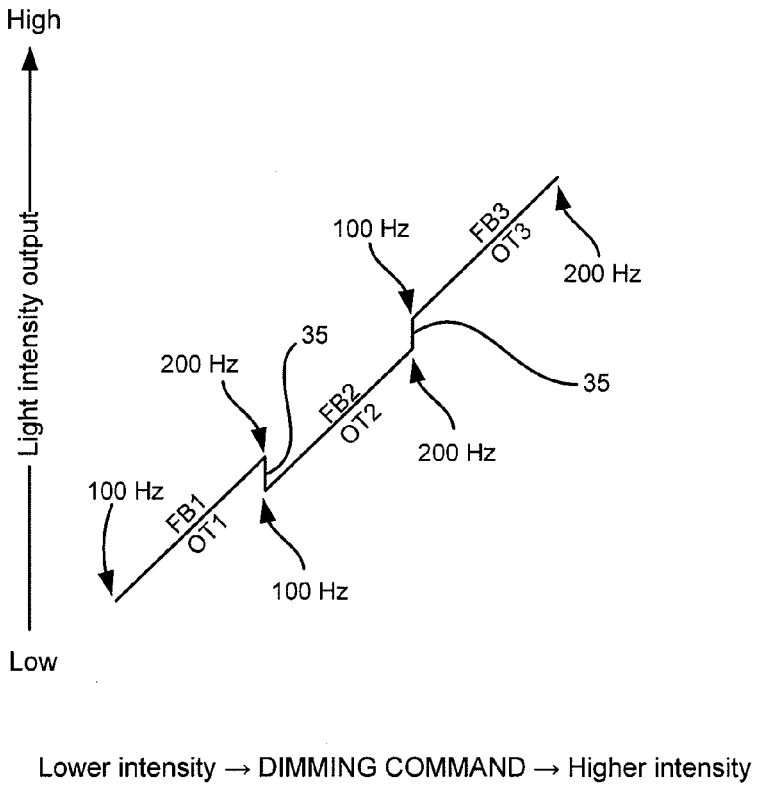
FIGURE 3 (PRIOR ART)
FIG. 3 is a graph showing light intensity output vs dimming command for a hysteretic controlled current source with multiple variable frequency bands.

As another means of explanation, FIG. 3 is a graph of output light intensity as a function of a dimming command signal for a small portion of a dimming curve with a hysteretic controlled current source connected to a LED load.

The graph shows the result of transitioning between variable frequency bands where on time (OT1,OT2,OT3) is held constant and off time is reduced increasing the frequency within each band (FB1,FB2,FB3).

For example, FB1 represents a frequency band with a constant on time of OT1 and frequency variation from 100 Hz to 200 Hz. FB2 represents a frequency band with a constant on time of OT2 and a frequency variation from 100 Hz to 200 Hz. The transition point 35 represents the error that occurs when transitioning between frequency bands with different on times (OT1→OT2) as the light intensity is changed via the dimming command. This error is due to the deviation between the approximate equations for total charge [(Total Charge) $Q=I_{setpoint}\times T_{on}$] versus the actual charge as shown in FIGS. 1*a* and 1*b*.

Figure 4:
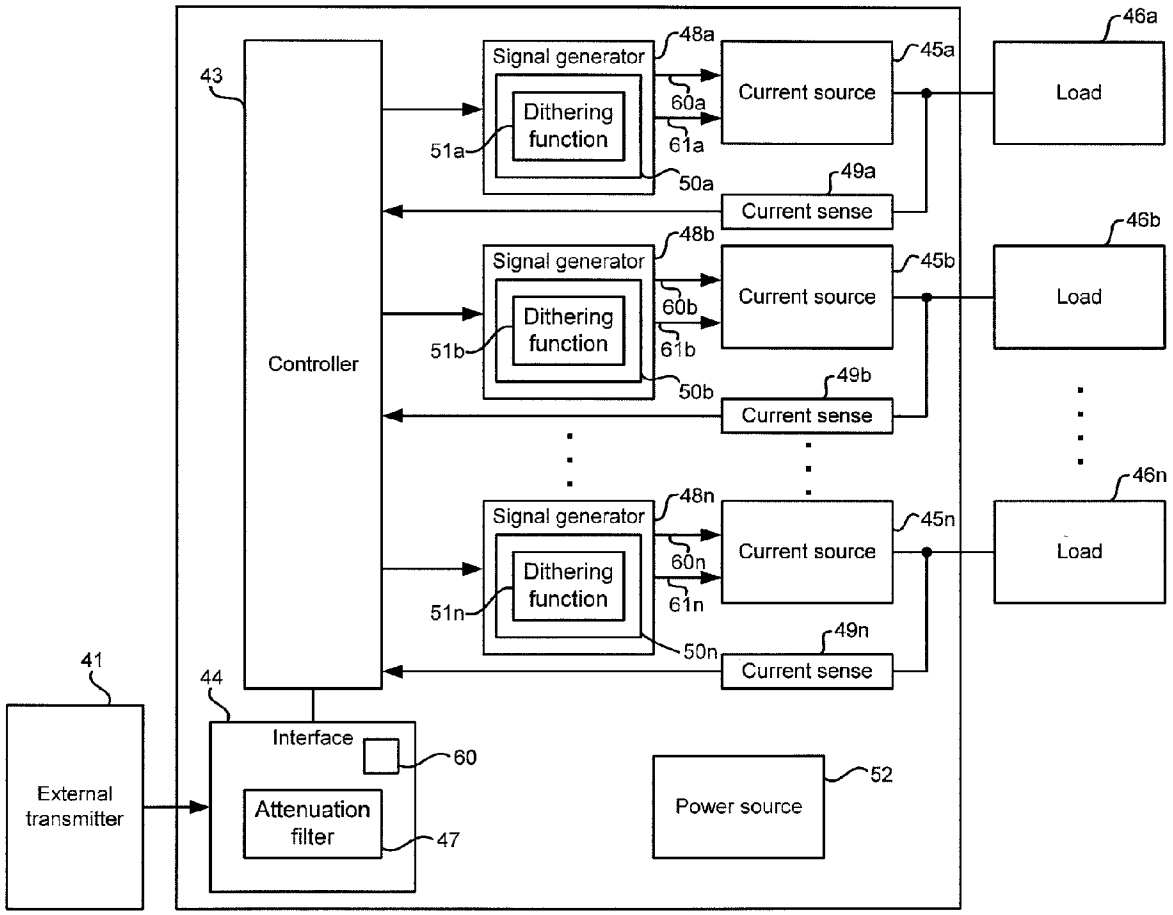
FIG. 4 is a schematic diagram of an embodiment of apparatus for controlling light emitting diodes (LEDs)

FIG. 4 is a schematic diagram of a first embodiment of apparatus for controlling LEDs by dithering between on time and off time pairs. The apparatus 40 comprises an interface 44 which includes an attenuation filter 47. The interface 44 receives signals from an external transmitter 41 or a data source that generates dimming or color changing command signals. Communication between the external transmitter 41 and the interface 44 may be via wired or wireless communication using any known communication protocol. During this communication, the external transmitter 41 may provide one or more command signals depending on the type of control desired.

In one embodiment, the external transmitter or data source 41 may be a DMX512A transmitter that generates packets of digital data based on the RS485 standard that defines the electrical characteristics of drivers and receives in a balanced digital multipoint system. This standard is also known as EIA-485 or TIA/EIA-485. The external transmitter may also be a 0-10Vdc Analog Control transmitter implemented by various protocols such as, but not limited to, ESTA E1.3-2001 "Lighting Control Systems 0-10 Vdc Analog Control Specification" for entertainment applications or IEC60929 "AC Supplied Electronic Ballasts for Tubular Lamps" for commercial lighting applications.

The apparatus 40 further comprises a controller 43, for controlling a plurality of loads, such as LED loads 46. The controller 43 is in communication with the interface 44 to receive the control information that was supplied by the external transmitter 41. The interface 44 may process the control signal from the external transmitter 41 prior to its transmission to the controller or the interface may simply transmit the signal to the controller 43 where the signal is then processed.

The controller 43 is also connected to a plurality of signal generators 48 individually denoted as 48*a* to 48*n*. It should be noted that the use of "n" does not mean there are only fourteen signal generators, but "n" may represent any value. Within each of the signal generators 48 is a processor 50 for implementing a dithering function 51. In one embodiment, the dithering function is implemented via an algorithm. The individual signal generator 48 receives two pairs of on and off times (on1, off1) and (on2, off2), plus a ratio between them typically implemented as "x" out of 16, where "x" is a number from 1 to 16. Dithering is achieved by using (on1, off1)x/16 of the time, and (on2, off2) is used 1−(x/16) of the time.

By dithering, the signal generator 48 alternates between one on/off time pair and the next according to a ratio in a pre-defined sequence, with the order of the sequence being arbitrary. For example, if the first on/off time pair (on1, off1) is used 5/16 of the time and the second on/off time pair (on2, off2) is used 11/16 of the time, a sample sequence may be 1111122222222222, or 112222211222222, or 1221222122122122 (where the digit 1 represents the first on/off time pair and the digit 2 represents the second on/off time pair). The sequence repeats quickly such that the change in intensity during the sequence (due to error) from on time 1 to on time 2 may not be noticed. Therefore, if the desired intensity for the LED is a value between (on1, off1) and (on2, off2) but closer to (on1, off1), the weighting will be selected so that the (on1, off1) weighting is higher than the (on2, off2) weighting for selected command levels.

In terms of the selected length of sequence, the length of sequence should be selected so that the total time taken by an entire sequence is small enough that a human eye will not notice any flicker. Suppose the sequence is 1111111211111111, with "1" digits representing the (on1/off1) pair, and "2" represents (on2/off2) pairs. If the (on2, off2) pair has a +5% error, and the (on1, off1) pair has a −5% error. There is a 10% difference in intensity. With the (on1, off1) and (on2, off2) pairs at a minimum of say 2 kHz (as in one embodiment), the entire sequence repeats at 2 kHz/16=125 Hz or so. Therefore, there is a 10% change in intensity (flicker) throughout the sequence, but this flicker is at >100 Hz, so it is not noticeable. Empirically, at 20 Hz a difference may be noticeable, at 100 Hz it will not, and in-between, different people may notice to some extent or another.

Alternatively, if a length of sequence of 128 is selected with the previous (on1, off1) and (on2, off2) pairs, with a weight of 127/128 for (on1, off1) and 1/128 for (on2, off2), the sequence would take 1/15th of a second (64 ms) to complete, or 15 Hz. Every 15th of a second, the intensity would rise and fall by 10%. This would be immediately noticeable as flicker.

Each signal generator is connected to a current source from a set of current sources 45, individually denoted as 45*a* to 45*n*. In the current embodiment, the signal generators and the current sources 45 are in a one-to-one relationship, however it is envisioned that a single signal generator could control multiple current sources. The current sources 45 preferably include ancillary circuitry for operation such as a buck circuit power conversion stage with hysteretic control.

The output of each current source 45 is connected to an associated external load 46 (seen as loads 46*a* to 46*n*) and an associated current sense 49 (individually denoted as 49*a* to 49*n*). Each current sense 49 is also connected to the controller 43 and forms part of a digital control feedback loop between the controller 43, the signal generator, the current source and the current sense.

A power supply 52 is also located within the apparatus to provide the necessary power for operation of the apparatus.

In operation, in the case of the external transmitter 41 comprising a DMX512A source, the controller 43 receives dimming or color mixing command signals preferably in the form of a serial data stream via the communication interface 44 and attenuation filter 47. After receiving the command signals, the controller translates the digital data stream into LED control information for use with the signal generator (s).

Alternatively, if the external transmitter 41 comprises a 0-10 Vdc analog data source, the communication interface 44 converts the 0-10 Vdc analog signal to a serial digital data stream before transmitting this serial digital data stream to the controller 43. In this embodiment, the communication interface preferably comprises an analog to digital converter 60. After the controller 43 receives the dimming or color mixing command signals in the form of the serial digital data stream, the controller then translates this data stream into LED control information. Other embodiments may use other data transmission techniques (such as parallel transmission or radio) to provide data to the controller 43.

In one embodiment, the attenuation filter 47 is preferably a low pass, digital filter that generates intermediate intensity values between dimming or color changing command signals received from the external transmitter 41. The attenuation filter may be an optional feature depending on the resolution of the intensity command signals provided by the external transmitter or data source 41.

The signal generator 48 typically transmits a digital signal 60 and an analog signal 61 to the current source 45 which combine to deliver load/LED control information preferably generated via a digital control algorithm and 1 Bit algorithm respectively such as described in US Patent Publication 2007/0103086, which is hereby incorporated by reference. The current source 45 provides current to its associated load 46 based on the LED control information. The current is provided while dithering between two variable frequency bands and corresponding variable periods, with at least two distinct values of on time. This results in LED average current to the load being encoded within the five variables of a first on time and off-time pair (on1, off1) and a second on time and off-time pair (on2, off2) as well as a ratio or weighting (n) between the pairs.

Neither the frequency at which the load is operating nor the time period for which it is operating is a constant over the dynamic range of light intensity. As such, the method outlined in FIG. 9 allows for maintenance of the output dimming frequency current within a narrow dynamic range. It will be further understood that specifying any two of on-time, off-time and period is mathematically equivalent, and that period and frequency are inversely related, and thus, it is equivalent to specify, for example, on-time and period or off-time and frequency in place of on-time and off-time.

Figure 5:
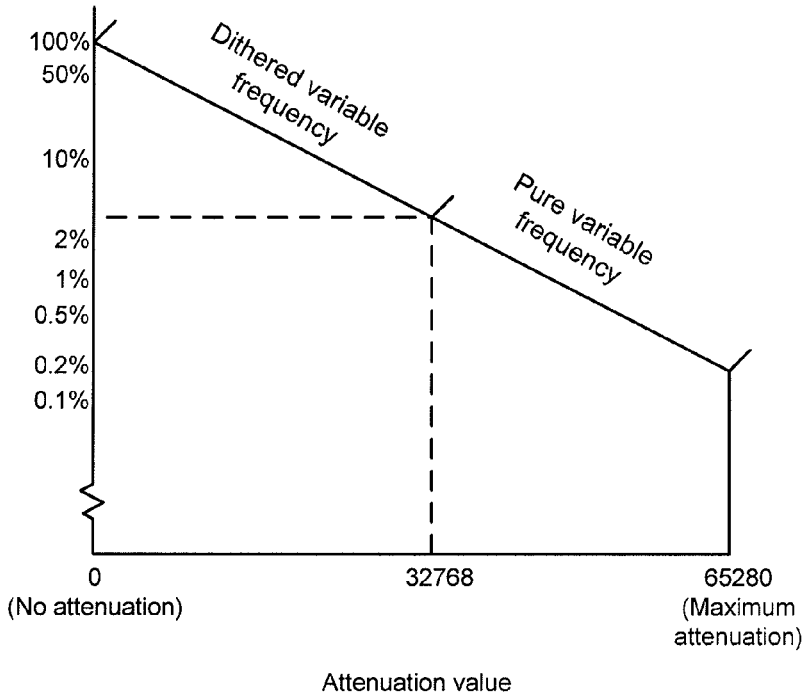
FIG. 5 is a graph showing filter attenuation vs light output intensity.

FIG. 5 shows an example graph of attenuation values generated by the attenuation filter versus the desired light intensity on a logarithmic scale. The light intensity as a percentage of full intensity is represented on the Y-axis while the attenuation value is listed on the X-axis.

As will be understood, the range of light intensities may be seen as a set of ranges. In FIG. 5, there are two ranges, a high intensity range and a low intensity range. Control of the SSL devices or LEDs in the high intensity range may be via a dithered variable approach while control of the SSL devices or LEDs in the low intensity range may be via a non-dithered variable approach such as a pure variable frequency method.

If there are more than two ranges, one of the ranges is controlled by the dithered variable approach and the remaining ranges are controlled by the non-dithered approach. Alternatively, control of the LEDs in each range of light intensities may be distributed between the dithered and the non-dithered approach.

The set of range of light intensities may be determined based on the components of the apparatus for controlling the LEDs. The set of range intensities may also be based on the implementation of the apparatus.

In operation, as referenced in FIG. 4, attenuation filter 47 receives a dimming or color changing command signal from the external transmitter 41 (via the interface 44) and generates an output number from 0 to 65280 which is transmitted to the controller 43 in the form of the digital data stream.

In one embodiment, the attenuation filter is an inverting, low pass, digital filter with a time constant determined to be aesthetically pleasing. It is understood that other low-pass filters might be used. In one example embodiment, implementation may be achieved as described below and represented by the following formula:

$$a(t)=a(t-1)+(255-\text{dimlevel}(t))\times 4-(a(t-1)/16)$$

where:

a(t) the current output filter attenuation value represented by a number from 0 to 65280;

a(t−1) is the previous output filter attenuation value represented by a number from 0 to 65280; and dimlevel(t) is a current value from 0 to 255 received from the external transmitter based on a 8 bit dimming or color changing command such as from a DMX512A source or a value from 0 to 255 generated by the interface based on the digital to analog conversion of an analog 0-10 Vdc signal received from external transmitter.

The gain is −256 times the 'dim level' and the output values of a(t) are generated about 122 times per second. Conceptually, the attenuation filter value a(t) is the inverse of the dimlevel(t) and is at its maximum value when dimlevel(t) is at a minimum value and a(t) is at its minimum value when dimlevel(t) is at its maximum.

As shown in FIG. 5, a dithered variable frequency method is implemented for a range of output light intensities from 100% full output to typically 4% of light output. A non-dithered, pure variable frequency method is implemented for a range of light output intensities from typically 4% to typically 0.2% of light output. The attenuation value generated by the attenuation filter in FIG. 4 is a function of the dimming intensity level received from the external transmitter and the previous attenuation value as shown in the above equation.

The point of transition between a dithered variable frequency approach and a non-dithered variable frequency approach is dependent on the capability of the hardware to generate a reasonable pulse width and can be modified without limiting the subject matter disclosed herein.

A non-dithered variable frequency method is implemented as the difference in error becomes significant between actual versus calculated pulse widths for consecutive and distinct pulse widths while transitioning between light intensity levels.

Similarly, the dynamic range of 100% to 0.2% can be modified without limiting the disclosure.

Furthermore, the dithering function implemented by means of an algorithm may also be applied to other control methods other than hysteretic control where errors are generated between actual and calculated current pulse widths supplied to a load.

For low light intensity levels as shown in FIG. 5 and corresponding current pulses supplied by the current source to the load typically less than 4% of light intensity, also seen as non-dithered variable frequency operation, the signal generator computes the required period and resulting frequency as follows:

$$\text{Period}_{nondith}(t)=VF_\text{Period}\times C^{((a(t)-65280)}$$

where:

$\text{Period}_{nondith}$(t) is the sum of the desired (on time+off time) required for a given attenuation value a(t). The on time is chosen such that at the highest non dithered variable frequency used, the on time and off time equals one of the on times used in the dithered variable frequency mode;

VF_Period is the maximum period of time desired using non-dithered variable frequency modulation;

C is contrast ratio defined as the ratio between the highest light output to the lowest light output. The contrast ratio is 500, calculated as (100%/0.2%)=500 and is adjustable; and a(t) is the current output filter attenuation value represented by a number from 0 to 65280.

For light intensity levels typically greater than 4% as shown in FIG. 5, also seen as dithered variable frequency operation, and corresponding current pulses supplied by the current source to the load, the signal generator computes the required period of time and resulting frequency as follows:

$$\text{Period}_{dith}(t)=\text{OT}\times C^{a(t)/65280}$$

where:

$\text{Period}_{dith}$(t) is the sum of the desired (on time+off time) required for a given attenuation value at:

OT is the pulse duration or on-time value stored in a look up table;

C is contrast ratio defined as the ratio between the highest light output to the lowest light output as above; and at the current output filter attenuation value represented by a number from 0 to 65280.

The computation for period $\text{Period}_{dith}$(t) is completed twice for two distinct on times (OT) and a dithering method with 4 bits of resolution gradually transitions between two on-time/period ratios and corresponding frequency bands in order to maintain a relatively narrow frequency band range.

For example, FIG. 6 shows a sample table and a dimming level value of 241 with an on-time/period pair of (OT1/P1) 346/486 and (OT2/P2) of 234/328 with a calculated intensity value of 71.19% and 71.13% respectively. The intensity value is equal to the duty cycle of on-time/period.

The dithered weighting for the OT1/P1 ratio at a dimming level of '241' is '1' and for the OT2/P2 ratio it is '15' meaning that the OT1/P1 ratio is utilized 1 out of 16 times and the OT2/P2 ratio is utilized 15 out of 16 times.

As the dim level changes based on commands from the external transmitter or data source to '238', the dithered weighting changes for OT1/P1 to 14 out of 16 times and OT2/P2 to 2 out of 16 times.

Any desired weighting may be implemented between OT/P pairs and corresponding frequency bands and dithering can also be implemented for more than two frequency bands. The on-times (OT1,OT2) are significantly different but the duty cycle (OT/P) for each pair is essentially the same.

On-times (OT1,OT2 . . . OTn) are chosen to ensure multiple frequency bands may be utilized over the light intensity range where a dithered variable frequency method is implemented. The difference in on-time values for each OT/P pair for example OT1=346 us and OT2=234 us for a dim level of 241, is dependent on the desired number of frequency bands and desired contrast ratio (C). Each on-time (OT) is chosen to be a fixed multiple of the previous on-time, such that the requirements for contrast ratio (C) and number of desired variable frequency bands are met.

The table shown in FIG. 6, also shows the generation of intermediate light intensity levels by the attenuation filter between dimming level commands received from an external transmitter. For example, for a transition between dim level of '240' down to dim level of '239', three intermediate desired intensity levels (68.96%, 68.54%, 68.12%) are shown.

In one implementation, times are implemented using a counter that increments every 2 microseconds. The limitations of the counter require a rounding or truncation of the on-time to a multiple of the clock period in this instance, 2 microseconds. The result is that there may be duplicate OT/P pairs generated such as at dimming command level 239 (67.71% desired light intensity) and subsequent intermediate desired intensity level of 67.30% for OT2/P2=160/236.

Figure 7:
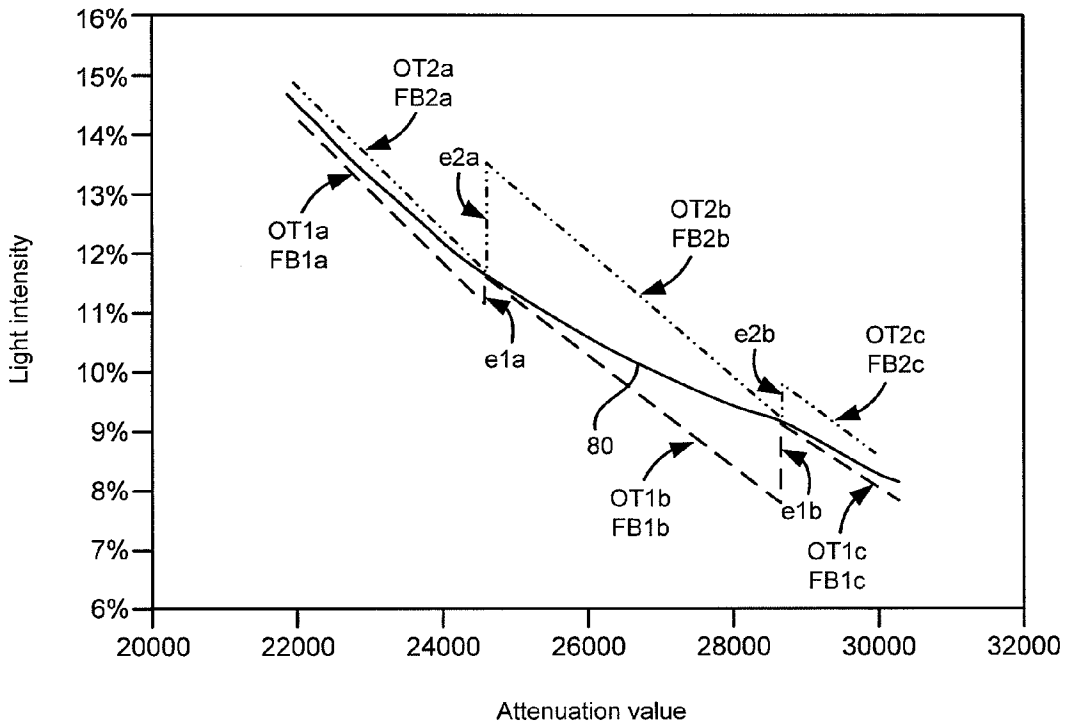
FIG. 7 is a graph showing a dithered light intensity response vs attenuation number.

FIG. 7 shows the dithered light intensity response curve 80 at relatively low light intensities and corresponding attenuation values. The graph also shows two non-dithered light intensity response curves with distinct on-times (OT1*a*, OT1*b*,OT1*c*) and (OT2*a*,OT2*b*,OT2*c*) and corresponding frequency bands (FB1*a*,FB1B,FB1*c*) and (FB2*a*,FB2*b*, FB2*c*) respectively.

The error terms (e1*a*,e2*a*,e1*b*,e2*b*) represent the error that occurs when transitioning between different on-times OT1→OT2 and corresponding frequency bands (FB1→FB2) as the light intensity changes with attenuation value via the dimming command. Note the differences in error and rapid changes in error that can result during transitions shown graphically between e1*a* and e2*a*. It is the difference in error between the actual versus calculated pulse width for consecutive and distinct pulse widths that is important.

For example, if a pulse width (OT1) has a 5% error between actual charge (Qxactual) versus calculated charge (Qxcalculated) and pulse width (OT2) has an error between actual charge (Qyactual) versus calculated charge (Qycalculated) of 10%, then a visible 5% jump in light intensity can be expected as the dimming command signal transitions between different intensity levels.

Figure 8:
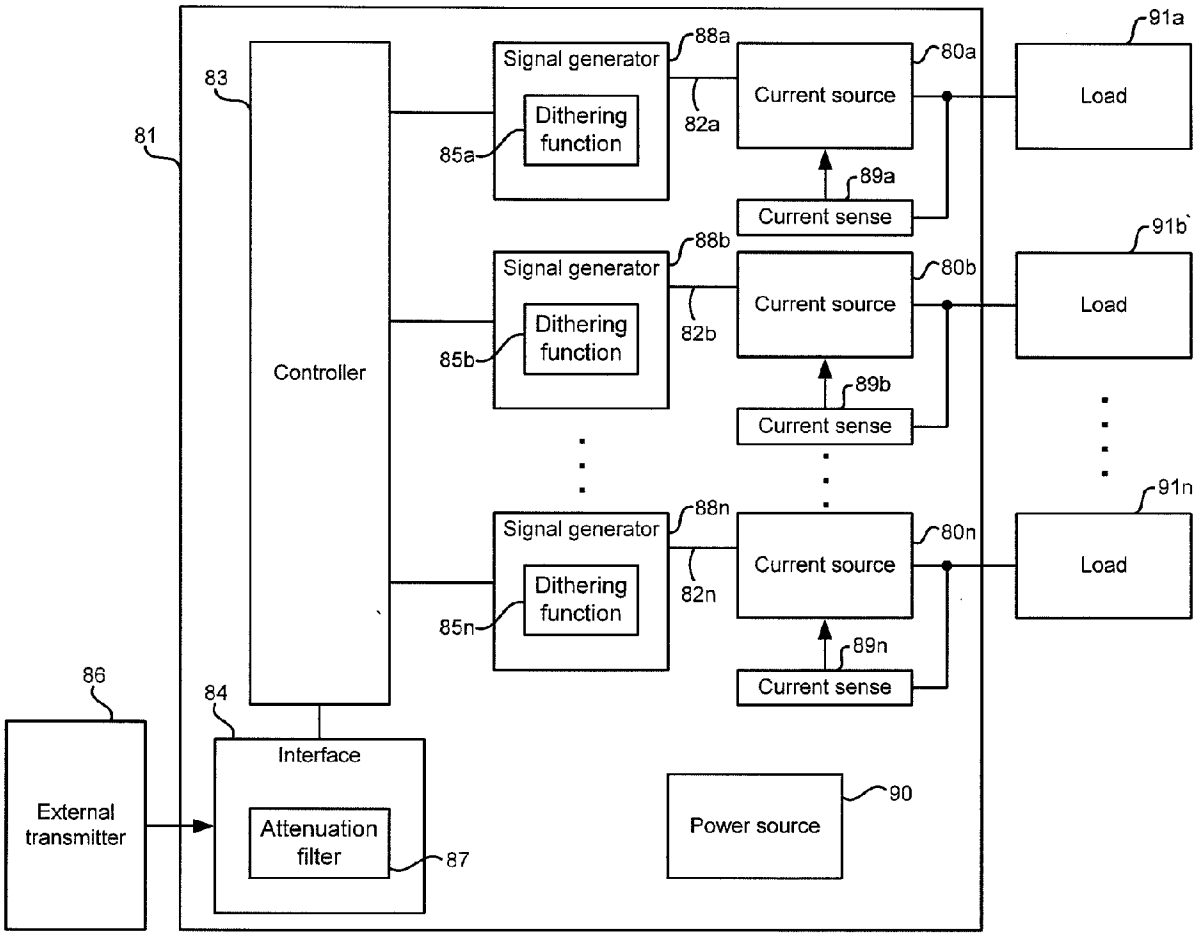
FIG. 8 is a schematic diagram of another embodiment of apparatus for controlling LEDs.

Turning to FIG. 8, a second embodiment of apparatus for controlling a load is shown. As with other embodiments, the apparatus 81 comprises an interface 84 and optional attenuation filter 87 for communicating with an external transmitter 86 to receive dimming and/or color mixing information, a controller 83 for translating the dimming and color mixing information to load control information, at least one signal generator 88 with an associated dithering function 85, which receives the load control information from the controller 83, at least one current source 80 with one associated current sense 89 for providing the necessary current to power an associated load 91.

In this embodiment, the current source 80 comprises an independent current sense 89, which forms part of a feedback loop to assist in controlling the current source directly. The analog signal computation is omitted and only the digital signal 82 is used to provide load control information. A power supply 90 is also located within the apparatus.

In a further embodiment, the current sense may be removed and the current source may comprise a simple linear regulator as opposed to a switch mode converter configured as a current source. In this embodiment the analog signal computation is omitted as well and only the digital signal 82 is used to provide load control information.

In another alternative embodiment, each of the current sources may be contained within a remote mounted module or may be a monolithic component of the apparatus. It is understood that the current sources 80 may comprise many alternate topologies so long as they can be turned "on" and "off" through a digital signal. Furthermore, the feedback loop may be removed if the current provided by the current source is the desired peak current for a given application of LEDs.

In yet a further embodiment, the controller 83 and one or more signal generators 88 are located within a microcontroller.

Figure 9:
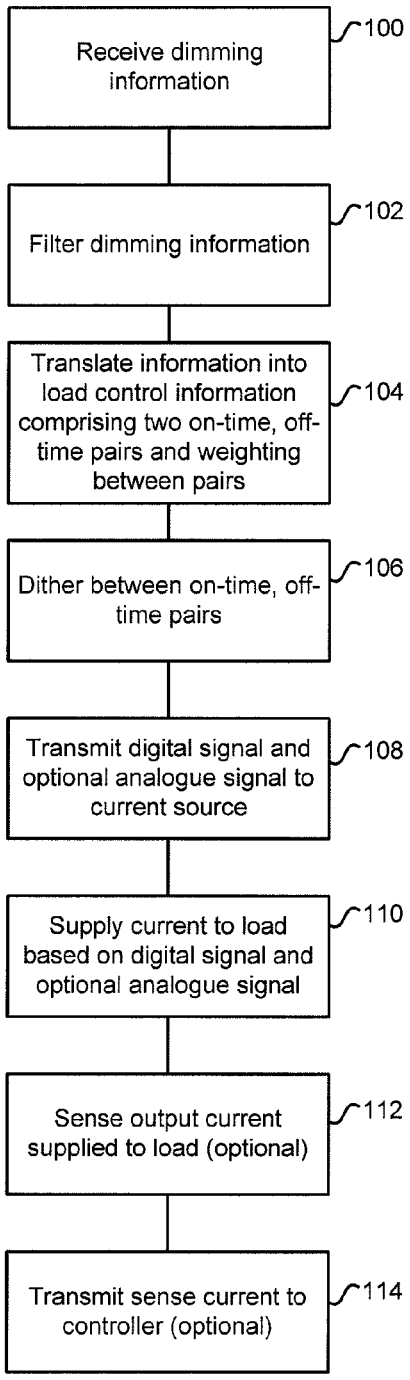
FIG. 9 is a flowchart outlining a method of controlling LEDs.

FIG. 9 is a flowchart outlining one embodiment of a method of controlling LEDs. In operation, to activate the system, the interface receives 100 dimming, or light intensity, information, such as from an external transmitter. This dimming information may then be processed, or filtered 102, such as by the attenuation filter, if necessary. This processing may be performed either at the interface or in the controller depending on the requirements. For instance, if the information does not have to be filtered, it may be transmitted to the controller once it is received for processing by the controller. Alternatively, if filtering is required, the filtering of the information is performed by the interface before being transmitted to the controller. Once the controller receives the processed information, the controller translates 104 this information into LED control information. For instance, the information may be translated into weighted on/off time pairs. The LED control information is translated 106 into dithering information which is transmitted 108 to the current source.

In 106, in one embodiment, a signal generator is implemented by using the firmware of a controller or microcontroller to generate a sequence of digital logic level pulses of varying on and off times. These pulses are according to the on/off pairs and weighting ratio translated in 104, and thus implement a signal generator, such as one described in FIG. 4, with a dithering function. Transmission 108 is by direct electrical connection to the "Enable" or "Dim" line of a current source such as mentioned in FIG. 4, and optionally includes an analog level for control of the peak current. After digital conversion, the sensed current signal can be used for closed loop control of the optional analog signal.

The current source then supplies 110 power to the LED load based on this dithering information in order to control the LEDs as per the instructions from the external transmitter. The output current of the load may be sensed 112 and then transmitted 114 to the controller to provide feedback information associated with the powering of the LED loads.

In dithering between variable frequency bands (as represented by the weighted on/off time pairs), when intensity is changed, the relative error introduced during the transition from one on-time to another is reduced. If multiple on times, corresponding to multiple variable frequency bands are used, errors in the current pulse may cause the transition from one on-time to the next to exhibit a sharp change in intensity. If instead, the transition from one frequency band to the other is gradual, made by gradually changing the ratio of one frequency band to another frequency band, the average light intensity as sensed by the eye also changes gradually. FIG. 6 provides a table outlining gradual change in the ratio of one frequency band to the next with respect to intensity.

The introduction of the digital filter may reduce the size of intensity changes, by introducing smaller intermediate steps. For example, if instead of a single 2.5% jump in intensity, there are 5×0.5% changes in intensity over the course of seconds, the change may not even be noticeable. While such a digital filter might be intuitive in other contexts, the DMX512A standard, which mandates exactly 255 levels, teaches against this.

In the preceding description, for purposes of explanation, numerous details are set forth in order to provide a thorough understanding of the embodiments of the disclosure. However, it will be apparent to one skilled in the art that these specific details are not required in order to practice the disclosure. In other instances, well-known electrical structures and circuits are shown in block diagram form in order not to obscure the disclosure. For example, specific details are not provided as to whether the embodiments of the disclosure described herein are implemented as a software routine, hardware circuit, firmware, or a combination thereof.

The above-described embodiments of the disclosure are intended to be examples only. Alterations, modifications and variations can be effected to the particular embodiments by those of skill in the art without departing from the scope of the disclosure.

The invention claimed is:

1. A method of controlling solid state lighting (SSL) devices comprising:

receiving dimming information;

translating the dimming information into SSL control information, the SSL control information including load/LED control information which is translated to dithering information; and transmitting the SSL control information to a current source for controlling the SSL devices;

wherein the dithering information includes information associated with a transitioning between variable frequency bands where an on time pulse duration is held constant and a period is varied for a portion of a dimming intensity range; and wherein the dithering information includes a first pair of on and off times, a second pair of on and off times and a ratio between the first and second pairs of on and off times, the ratio representing an amount of time the first pair of on and off times is used with respect to the second pair of on and off times.

2. The method of claim 1 wherein translating comprises:

translating the dimming information into the first and second pair of on and off times; and determining the ratio between the two pairs.

3. The method of claim 2, where the ratio between the first and second pair of on and off times reduces flicker.

4. The method of claim 1 further comprising:

digitally filtering the dimming information before translating said dimming information into the first and second pair of on and off times.

5. The method of claim 1 wherein the SSL devices are light emitting diodes (LEDs), organic LEDs or power LEDs.

6. The method of claim 1 wherein change in consecutive dimming command levels is less than 3% of intensity change.

7. The method of claim 1 wherein the on-time is held constant for at least two consecutive dimming command levels.

8. A method of controlling solid state lighting devices comprising:

using a dithered variable frequency approach for a first range of light intensities for white light illumination according to dithering information; and using a non-dithered pure variable frequency approach for at least a second range of light intensities for white light illumination wherein the dithering information includes information associated with a transitioning between variable frequency bands where an on time pulse duration is held constant and a period is varied for a portion of a dimming intensity range; and wherein the dithering information includes a first pair of on and off times, a second pair of on and off times and a ratio between the first and second pairs of on and off times, the ratio representing an amount of time the first pair of on and off times is used with respect to the second pair of on and off times.

9. The method of claim 8 wherein the first range of light intensities is a high intensity range.

10. The method of claim 8 wherein the at least a second range of light intensities is a low intensity range.

11. The method of claim 8 wherein the on-time is held constant for at least two consecutive dimming command levels.

* * * * *